US007284821B2

(12) United States Patent
Jones et al.

(10) Patent No.: US 7,284,821 B2
(45) Date of Patent: Oct. 23, 2007

(54) SYSTEM AND METHOD FOR LEVELING PRINTHEAD CARRIAGE USAGE

(75) Inventors: Morgan Jones, San Diego, CA (US); William S. Osborne, Camas, WA (US); Jason R. Arbeiter, Poway, CA (US); Ronald A. Askeland, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 254 days.

(21) Appl. No.: 10/830,833

(22) Filed: Apr. 23, 2004

(65) Prior Publication Data

US 2005/0237358 A1 Oct. 27, 2005

(51) Int. Cl.
*B41J 23/00* (2006.01)

(52) U.S. Cl. ..... 347/37

(58) Field of Classification Search ..... 347/37, 347/49

See application file for complete search history.

(56) References Cited

U.S. PATENT DOCUMENTS 5,003,323 A * 3/1991 Onuki et al. ..... 347/171
5,593,240 A * 1/1997 Broder et al. ..... 400/352
5,838,343 A * 11/1998 Chapin et al. ..... 347/22
5,917,508 A 6/1999 Lopez et al.
6,000,781 A * 12/1999 Akiyama et al. ..... 347/40
6,227,659 B1 5/2001 Lopez et al.
6,290,326 B1 * 9/2001 Hipp et al. ..... 347/37
6,318,840 B1 * 11/2001 Sette et al. ..... 347/37
6,467,887 B2 10/2002 Lopez et al.
6,896,348 B2 * 5/2005 Takekoshi et al. ..... 347/15
6,905,192 B2 * 6/2005 Rasmussen ..... 347/40
2004/0174410 A1 * 9/2004 Wu ..... 347/33

* cited by examiner

*Primary Examiner*—Stephen Meier
*Assistant Examiner*—Jason Uhlenhake

(57) ABSTRACT

A media print system includes two or more printhead carriages adapted to print on a medium in a print area, the print area including two or more print regions. Each of the printhead carriages is adapted to print in one or more of the print regions. The system also includes a controller adapted to reconfigure a positioning of the two or more printhead carriages in a configuration selected from a predetermined set of configurations. The controller is adapted to reconfigure the positioning each time a predetermined criterion is satisfied.

27 Claims, 7 Drawing Sheets

SYSTEM AND METHOD FOR LEVELING PRINTHEAD CARRIAGE USAGE

BACKGROUND OF THE INVENTION

The present invention relates generally to the field of printers. In particular, the invention relates to methods and systems for leveling the usage of printheads in printers having multiple printhead carriages.

Certain types of printers, such as indexing carriage printers, can have multiple carriages with printheads containing identical ink sets. Each carriage is positioned to print one region along the width of a print area. Thus, the multiple carriages combine to cover the entire width of the print area.

Over the long term, certain regions of the print area may require more printing than others. For example, in printing text, much of the printing may be required in a central region when the text is provided with side margins. Thus, certain printhead carriages may be used at a much greater rate than others.

SUMMARY OF THE INVENTION

One embodiment of the invention relates to a media print system. The system includes two or more printhead carriages adapted to print on a medium in a print area, the print area including two or more print regions. Each of the printhead carriages is adapted to print in one or more of the print regions. The system also includes a controller adapted to reconfigure a positioning of the two or more printhead carriages in a configuration selected from a predetermined set of configurations. The controller is adapted to reconfigure the positioning each time a predetermined criterion is satisfied.

Another embodiment of the invention relates to a method of controlling a printer. The method includes selecting a configuration from a set of predetermined configurations of positions of two or more printhead carriages adapted to print on a medium in a print area including two or more print regions. Each of the printhead carriages is adapted to print in one of the print regions. The method also includes reconfiguring a positioning of the two or more printhead carriages in the selected configuration when a predetermined criterion is satisfied.

It is to be understood that both the foregoing general description and the following detailed description are exemplary and exemplary only, and are not restrictive of the invention as claimed.

DETAILED DESCRIPTION OF CERTAIN EMBODIMENTS

Figure 1:
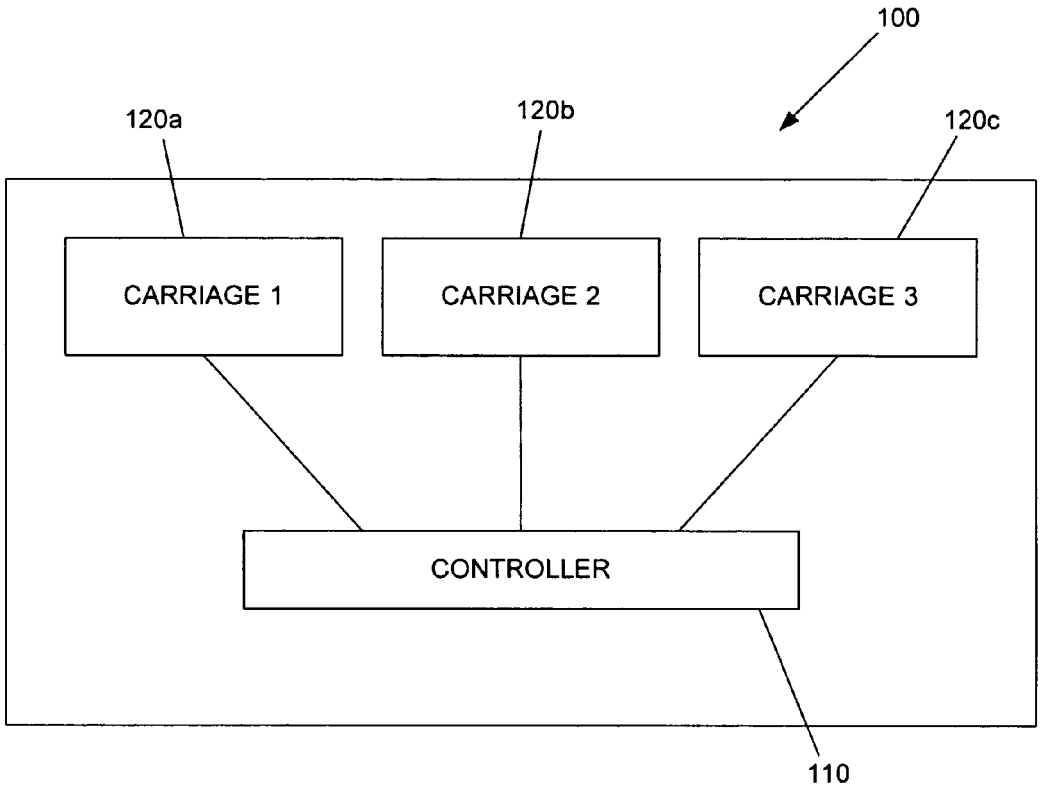
FIG. 1 is a; schematic illustration of a media print system according to an embodiment of the invention.

Referring to FIG. 1, an embodiment of a media print system is schematically illustrated. The media print system

100 includes a controller 110 for controlling a plurality of printhead carriages 120*a-c*. The controller 110 may be implemented as hardware, software or firmware in a printer, for example. The controller 110 is adapted to control operation of the printhead carriages 120*a-c*, including positioning of each printhead carriage 120*a-c*, as described below. Communication between the controller 110 and the printhead carriages 120*a-c* may be achieved in any of a variety of ways, including a wired link.

Each printhead carriage 120*a-c* may include a thermal inkjet printhead, for example. In this regard, the media print system 100 may be an inkjet printer. Such printers and printheads are well known to those skilled in the art. Although the illustrated embodiment shows three printhead carriages 120*a-c*, the number of printhead carriages may be varied for a particular implementation.

Figure 2A:
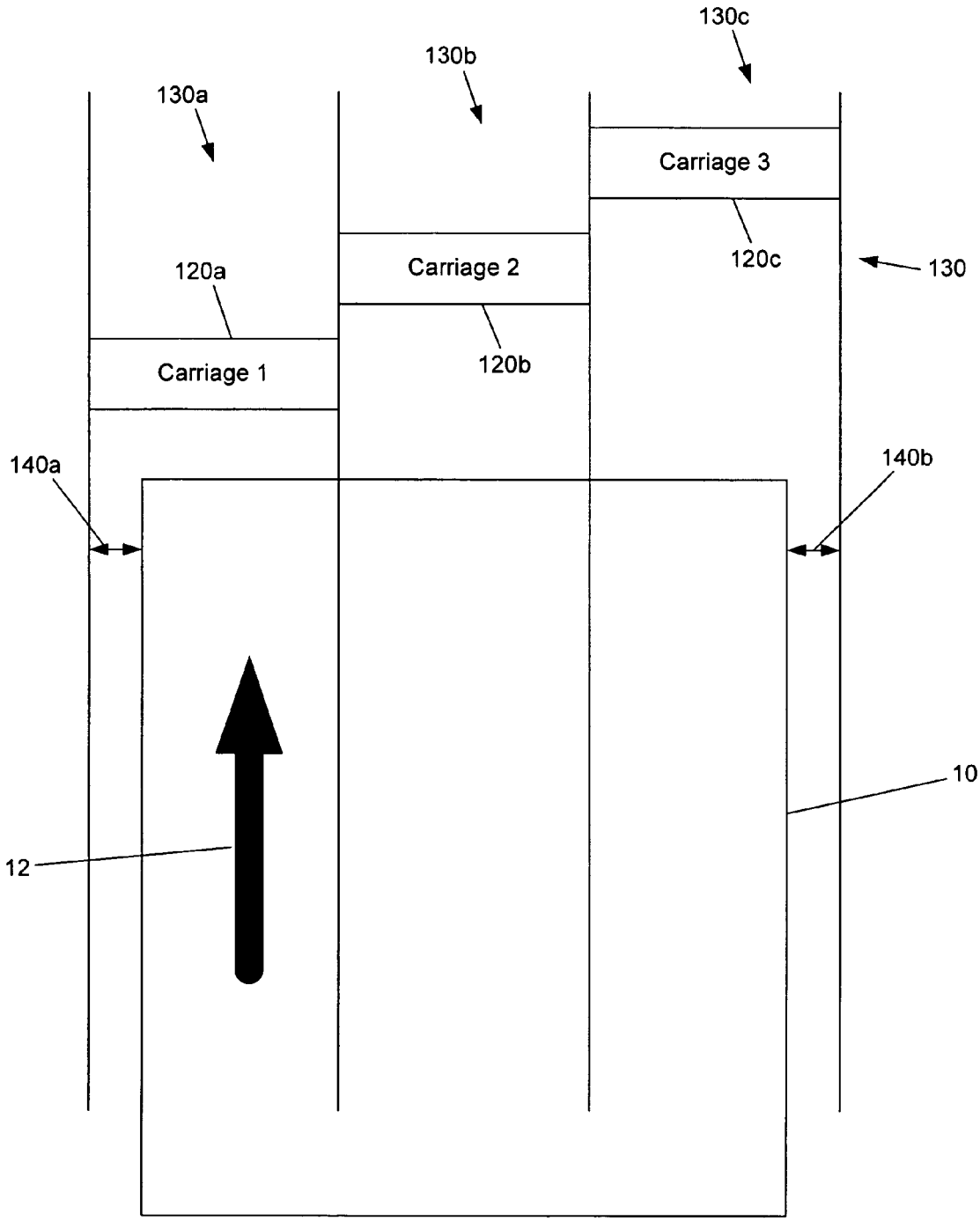
FIGS. 2A-2C illustrate the positioning of printhead carriages according to an embodiment of the invention.
Figure 2B:
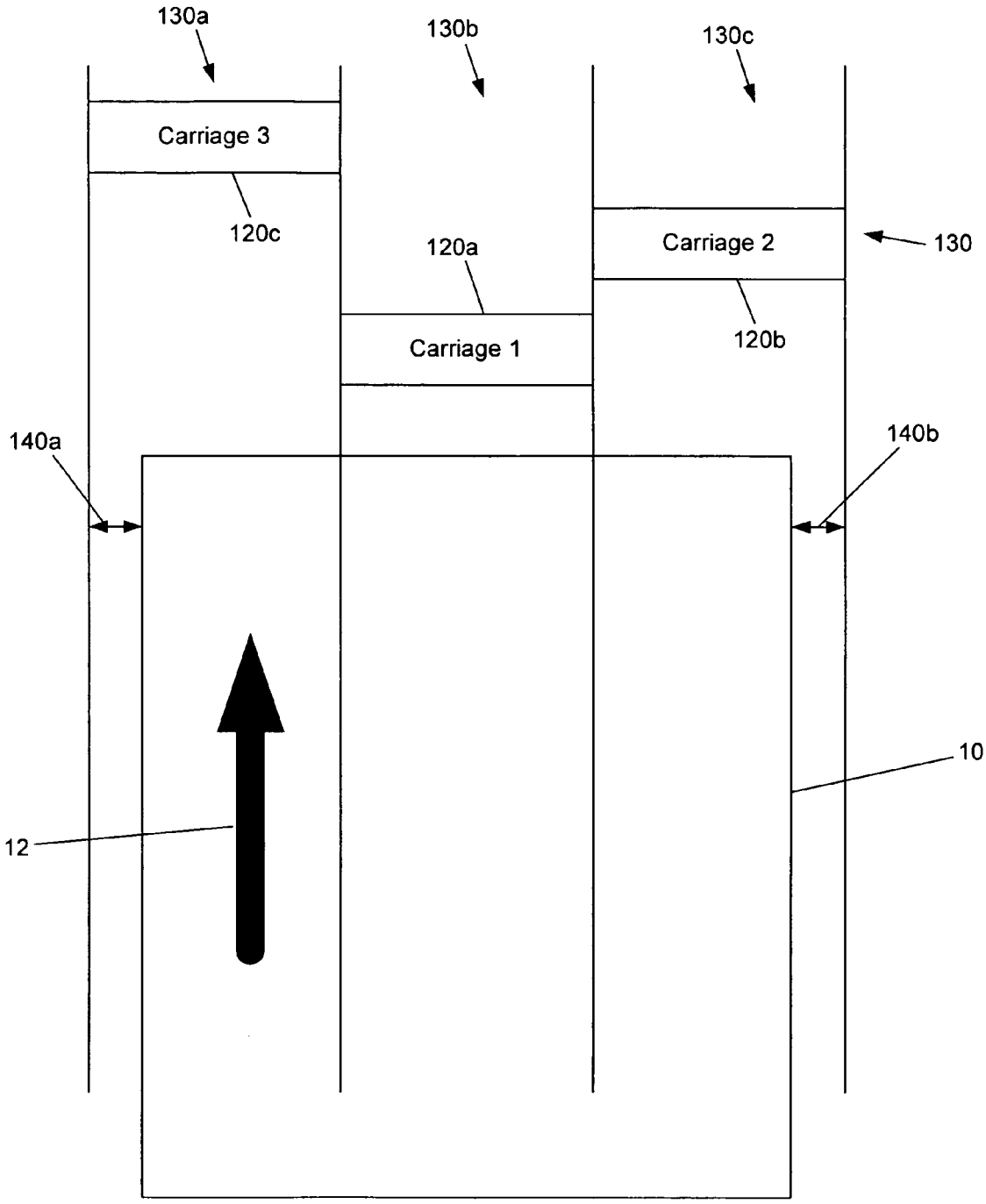
Figure 2C:
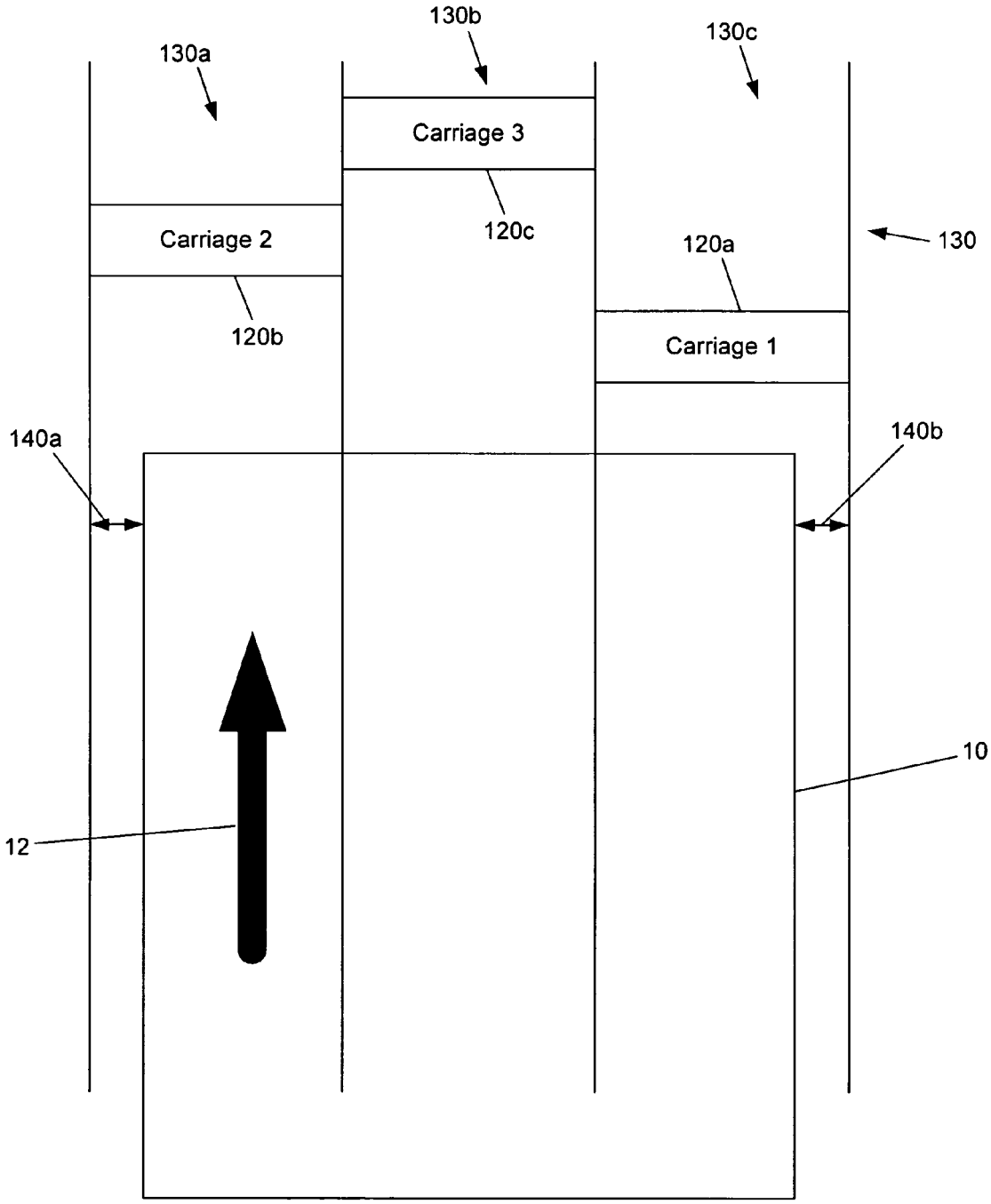

FIGS. 2A-C illustrate the operation of the controller 110 (FIG. 1) in controlling the position of the printhead carriages 120*a-c*. A print area 130 is divided into a plurality of print regions 130*a-c* which form the entire width of the print area 130. In the illustrated embodiments, the print area 130 is divided into three print regions 130*a-c*, although the print area 130 may be divided into any plurality of print regions.

The number of print regions 130*a-c* in the illustrated embodiments corresponds to the number of printhead carriages. However, it is possible that the number of print regions is different from the number of printhead carriages. For example, a print area may be divided into three print regions in a system having four carriages. In this example, one of the carriages may be idle at all times. In other embodiments, the number of printhead carriages may be less than the number of print regions. In such cases, the print medium may make multiple passes through the print region with each printhead carriage covering one region per pass. Thus, for example, in a large format printer that prints on a 34-inch wide medium, a printer may be provided with two printhead carriages, each having a coverage width of 4.25 inches. Thus, the 34-inch medium may be divided into eight print regions, and the print medium may be passed through the print area four times.

As a further example, in a printer having two printhead carriages having a coverage width of 4.25 inches each and a print medium having a width of 11 inches, The 11-inch width of the medium may be divided into three regions of 4.25, 4.25 and 2.5 inches, respectively. In a first pass, each printhead carriage may cover one of the 4.25-inch region. The 2.5-inch region may be covered during a second pass by a different part of different carriages at various times. In this regard, at least a portion of one carriage and the entirety of the other carriage may be idle during the second pass.

Referring again to FIG. 2A, a print medium 10, such as a sheet of paper, is processed through the print area in a feed direction (indicated by the arrow) 12. The feed direction 12 is generally perpendicular to the width of the print area.

The printhead carriages 120*a-c* are shown in FIG. 2A as being positioned in a configuration selected by the controller 110 (shown in FIG. 1) from a predetermined set of configurations. Each configuration in the predetermined set assigns a specific printhead carriage 120*a-c* to a specific print region 130*a-c*. FIG. 2A illustrates one such configuration in which Carriage 1 (120*a*) is assigned to the left print region 130*a*, Carriage 2 (120*b*) is assigned to the center print region 130*b*, and Carriage 3 (120*c*) is assigned to the right print region 130*c*.

When the controller 110 (FIG. 1) determines that a predetermined criterion has been satisfied, it selects another configuration from the set of configurations. In a particular embodiment, the criterion may be based on the number of print jobs processed in the current configuration. In this regard, the positioning of the printhead carriages may be reconfigured after a set number of print jobs. In one embodiment, the controller 110 reconfigures the position of the printhead carriages after each print job. Of course, other criterion may be used to initiate the reconfiguration. For example, the position of the carriages may be reconfigured after a predetermined number of pages have been printed.

Thus, with the printhead carriages in the configuration illustrated in FIG. 2A, when the controller 110 determines that the predetermined criterion has been satisfied, it selects another configuration and reconfigures the positioning of the printhead carriages. FIG. 2B illustrates a second configuration. In this configuration, each printhead carriage 120*a-c* has been moved to the print region 130*a-c* to the right of the previous position of the carriage 120*a-c*, and the rightmost carriage is moved to the left. Thus, in the configuration of FIG. 2A, Carriage 1 (120*a*) is moved to the center print region 130*b*, Carriage 2 (120*b*) is moved to the right print region 130*c*, and Carriage 3 (120*c*) is moved to the left print region 130*a*.

In this regard, the controller 110 may select a configuration in a sequential manner. The set of configurations may include a sequence of configurations through which the controller 110 rotates to select the next configuration. Thus, with the printhead carriages 120*a-c* in the configuration illustrated in FIG. 2B, when the criterion is again satisfied, the controller 110 advances the printhead carriages 120*a-c* to the next configuration in the sequence, as illustrated in FIG. 2C. In this configuration, Carriage 1 (120*a*) is assigned to the right print region 130*c*, Carriage 2 (120*b*) is assigned to the left print region 130*a*, and Carriage 3 (120*c*) is assigned to the center print region 130*b*.

Thus, the positioning of the printhead carriages may be rotated through a sequence of configurations. From left to right, the configurations may be represented as 1-2-3 (FIG. 2A), 3-1-2 (FIG. 2B), 2-3-1 (FIG. 2C), and then back to 1-2-3 again. By rotating through the various configurations, the probability of a single printhead being used at a substantially greater rate than the others is significantly reduced.

The print area 130 in the illustrated embodiment of FIGS. 2A-2C is wider than the width of the print medium 10. In this regard, the reconfiguring of the positioning of the printhead carriages allows each printhead carriage to have a portion of its printhead be idle at different times. For example, in the configuration of FIG. 2A, the left portion of Carriage 1 (120*a*) is positioned over a left overhang 140*a*, and the right portion of Carriage 3 (120*c*) is positioned over a right overhang 140*b*. Thus, the portions of the printheads over the overhangs 140*a*, 140*b* may be idle while the printhead carriages are in this configuration. Similarly, in the configuration of FIG. 2B, the left portion of Carriage 3 (120*c*) and the right portion of Carriage 2 (120*b*) are positioned over the overhangs 140*a*, 140*b*, while in the configuration of FIG. 2C, the left portion of Carriage 2 (120*b*) and the right portion of Carriage 1 (120*a*) are positioned over the overhangs 140*a*, 140*b*.

In one embodiment, the print medium 10 has a width of 8.5 inches, and each printhead carriage 120*a-c* has a width of 3.4 inches. Thus, the print area 130 has a width of 10.2 inches, and an overhang of 0.85 inches is provided on each side.

In another embodiment, the print medium 10 has a width of 8.5 inches, and each printhead carriage 120*a-c* has a width of 4.25 inches. Thus, the print area 130 has a width of 12.75, and an overhang of 2.125 inches is provided on each side. In this embodiment, the overhang is equivalent to one-half of the width of the printhead carriage. Thus, all portions of the each printhead carriage can be idle at various times.

As noted above, in one embodiment, the reconfiguration of the positioning of the printhead carriages is performed by selecting the configuration from a predetermined sequence of configurations. In other embodiments, the next configuration may be selected randomly from a predetermined set of configurations. The predetermined set of configurations may be identical to that described above with reference to FIGS. 2A-2C or may include a different set of configurations.

Figure 3:
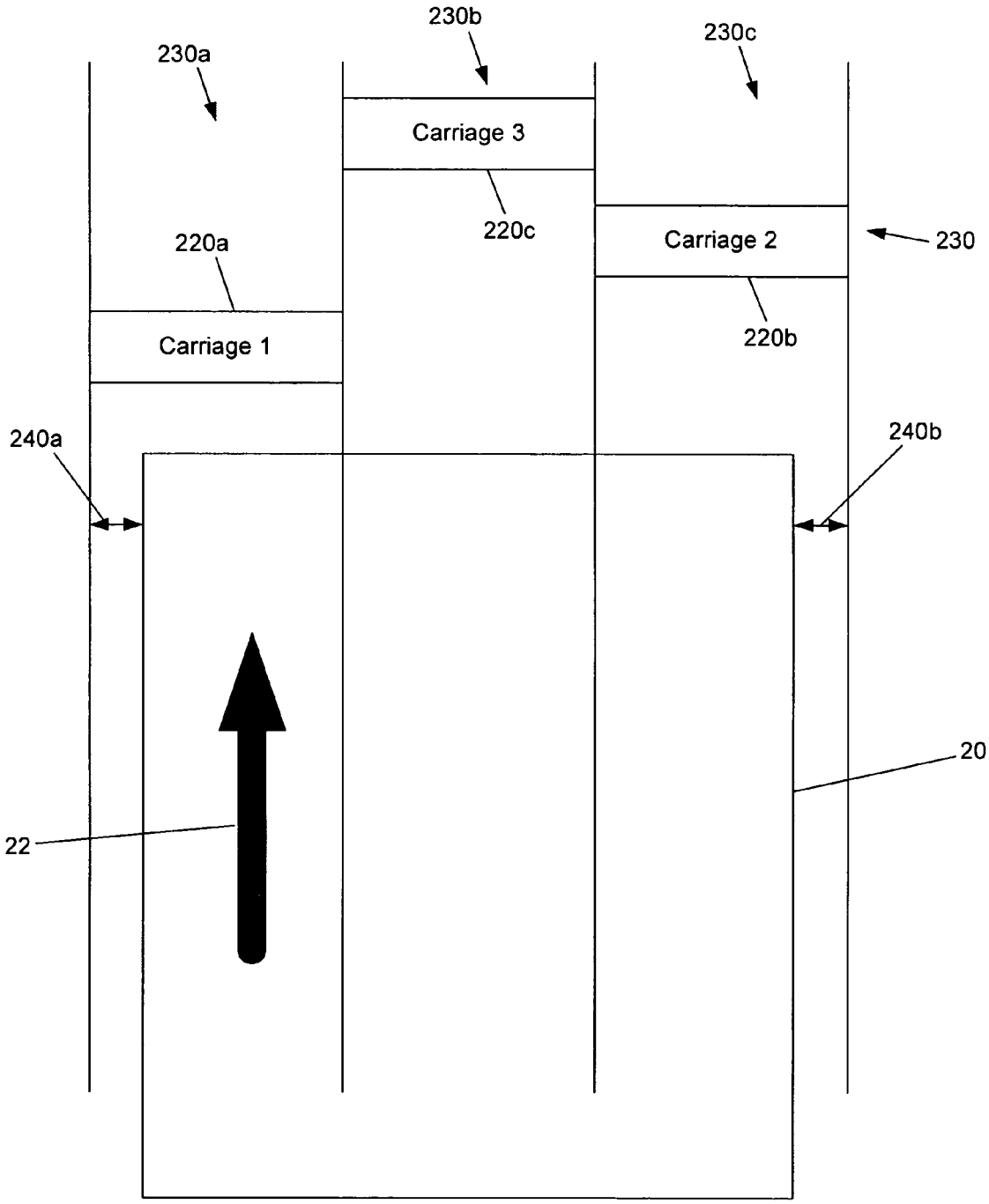
FIG. 3 illustrates the positioning of printhead carriages according to another embodiment of the invention.

FIG. 3 illustrates a configuration that me be selected randomly from a predetermined set of configurations. A print medium 20 is processed in a feed direction 22 through a print area 230. The print area 230 is divided into three print regions 230*a-c*, and three printhead carriages 220*a-c* are provided to print on the print medium 20 in each print region 230*a-c*. The configuration of positioning of the carriages may be selected from a set of configurations which may include all possible configurations. For example, the set may include carriages positioned as (from left to right): 1-2-3, 1-3-2 (shown in FIG. 3), 2-1-3, 2-3-1, 3-1-2, and 3-2-1.

Figure 4:
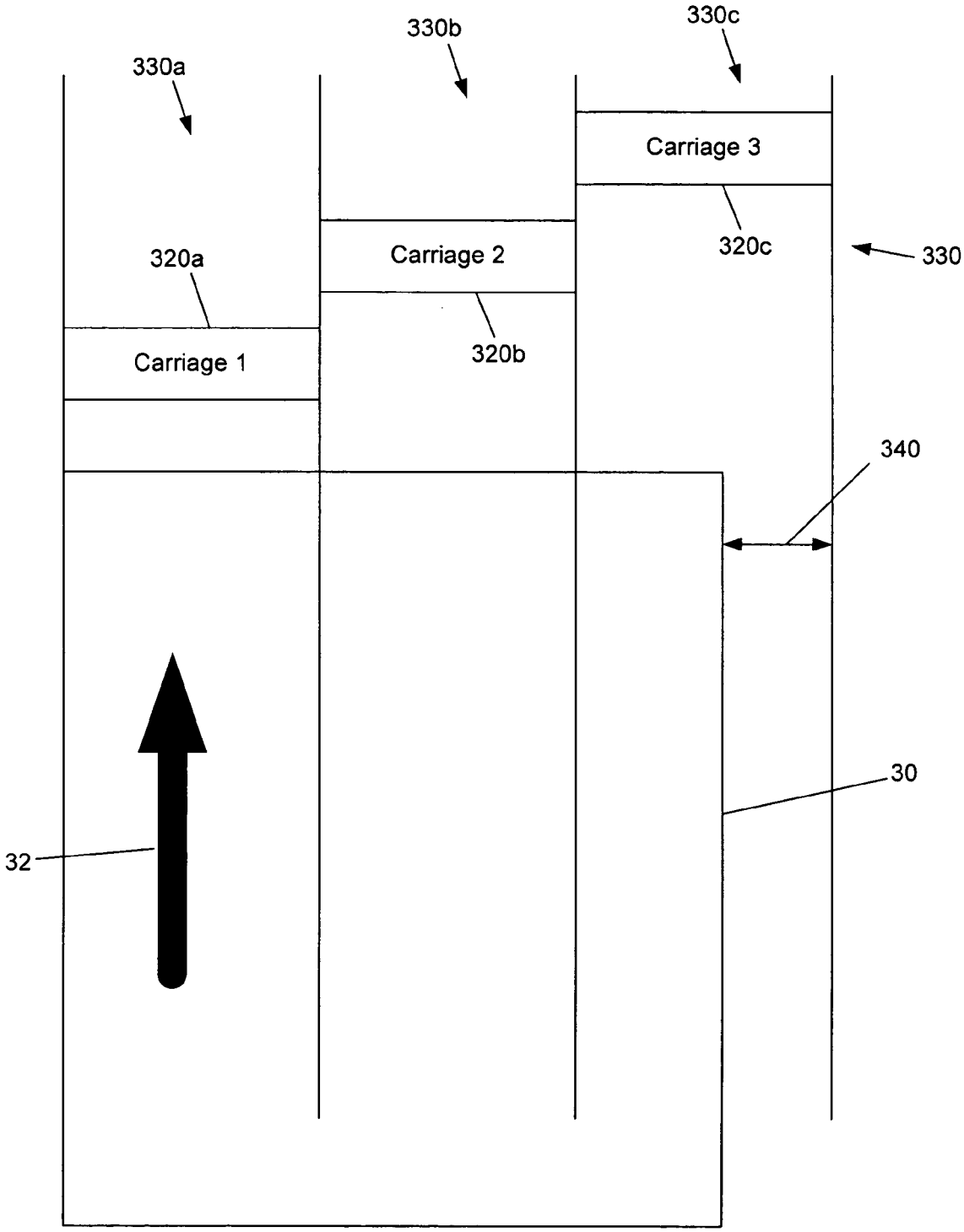
FIG. 4 illustrates the positioning of printhead carriages according to still another embodiment of the invention.

FIGS. 2A-2C and FIG. 3 illustrate embodiments in which the print medium is centered in the print area, thus providing an overhang on each side. In other configurations, the print medium may be positioned on one side of the print area, thus providing a larger overhang on the other side. One such embodiment is illustrated in FIG. 4. In this embodiment, a print medium 30 is processed in a feed direction 32 through print area 330. The print area 330 is divided into three print regions 330*a-c*, and three printhead carriages 320*a-c* are provided to print on the print medium 30 in the print regions 330*a-c*. Since the print area 330 is wider than the width of the print medium 30, an overhang 340 is formed on the right side of the print area 330. A printhead carriage 320*c* has a portion over the overhang 340 which is idle while the printhead carriages are in the illustrated configuration. Of course, the printhead carriages 320*a-c* and the print area 330 may be sized to adjust the size of the overhang 340 for a given print medium 30. For example, in one embodiment, the carriages 320*a-c* may be sized to provide an overhang 340 that is equivalent to the width of one carriage 320.

Figure 5:
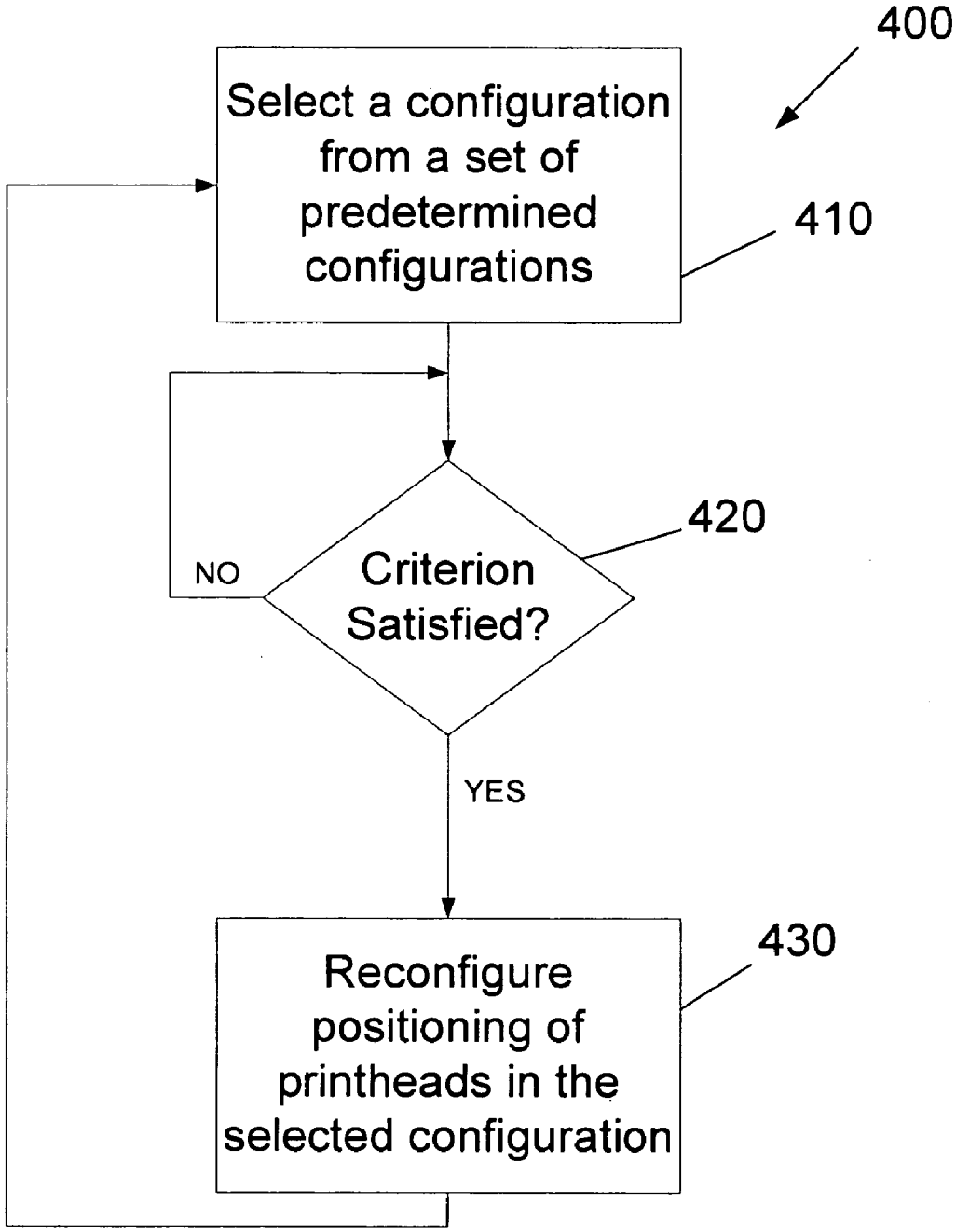
FIG. 5 is a flowchart illustrating a method of controlling a printer according to an embodiment of the invention.

FIG. 5 shows a flowchart illustrating the steps executed by the controller 110 (FIG. 1) in one embodiment. The process 400 includes selecting a configuration from a set of predetermined configurations of positions of two or more printhead carriages (block 410). As noted above, the selection of the configuration may be performed in a variety of ways, including according to a predetermined sequence of configurations or randomly from the set of configurations. At block 420, a determination is made as to whether a predetermined criterion has been satisfied. As noted above, the predetermined criterion may be based on various factors. In one embodiment, the criterion is based on the number of print jobs. Thus, the positioning of the printheads may be reconfigured after a predetermined number of print jobs. In another embodiment, the criterion is based on the number of pages processed. If the criterion is not satisfied, the process 400 waits and continues to monitor for the satisfaction of the criterion, as indicated by the "NO" branch from block 420. If the criterion is satisfied, the controller reconfigures the positioning of the printheads in the selected configurations (block 430), and the process 400 returns to block 410.

The foregoing description of embodiments of the invention have been presented for purposes of illustration and description. It is not intended to be exhaustive or to limit the invention to the precise form disclosed, and modifications and variation are possible in light of the above teachings or may be acquired from practice of the invention. The embodiment was chosen and described in order to explain the principles of the invention and its practical application to enable one skilled in the art to utilize the invention in various embodiments and with various modification as are suited to the particular use contemplated. It is intended that the scope of the invention be defined by the claims appended hereto and their equivalents.

What is claimed is:

1. A media print system, comprising:

two or more printhead carriages adapted to print on a medium in a print area, said print area including one or more print regions, each of said printhead carriages being adapted to print in one or more of said print regions; and a controller adapted to reconfigure a positioning of said two or more printhead carriages in a configuration selected from a predetermined set of configurations;

wherein said controller is adapted to reconfigure said positioning each time a predetermined criterion is satisfied to ensure that each of said printhead carriages is not used at a much greater rate than other said printhead carriages.

2. The system according to claim 1, wherein said controller is adapted to reconfigure said positioning after a predetermined number of print jobs.

3. The system according to claim 1, wherein said controller is adapted to reconfigure said positioning after a predetermined number of pages.

4. The system according to claim 1, wherein said controller is adapted to reconfigure according to a predetermined sequence of configurations.

5. The system according to claim 1, wherein said controller is adapted to reconfigure by randomly selecting a configuration from said set of configurations.

6. The system according to claim 1, wherein a number of printhead carriages and a member of print regions are equal.

7. The system according to claim 6. wherein said number of printhead carriages and said number of print regions is three.

8. The system according to claim 1, wherein a number of printhead carriages is greater than a number of print regions.

9. The system according to claim 8, wherein at least a portion of at least one printhead carriage is adapted to be idle during printing.

10. The system according to claim 1, wherein a width of said medium is smaller than a width of said print area, and wherein each configuration in said predetermined set of configurations includes at least a portion of at least one printhead carriage positioned beyond an edge of said medium.

11. The system according to claim 10, wherein said medium is centered in said print area.

12. A method of controlling a printer, comprising:

selecting a configuration from a set of predetermined configurations of positions of two or more printhead carriages adapted to print on a medium in a print area including one or more print regions, each of said printhead carriages being adapted to print in one or more of said print regions; and reconfiguring a positioning of said two or more printhead carriages in said configuration selected in said step of selecting when a predetermined criterion is satisfied to ensure that each of said printhead carriages is not used at a much greater rate than other said printhead carriages.

13. The method according to claim 12, wherein said step of reconfiguring includes reconfiguring said positioning after a predetermined number of print jobs.

14. The method according to claim 12, wherein said step of reconfiguring includes reconfiguring said positioning after a predetermined number of pages.

15. The method according to claim 12, wherein said step of selecting selects a configuration according to a predetermined sequence of configurations.

16. The method according to claim 12, wherein said step of selecting includes randomly selecting a configuration from said set of configurations.

17. The method according to claim 12, wherein a number of printhead carriages and a number of print regions are equal.

18. The method according to claim 17, wherein said number of printhead carriages and said number of print regions is three.

19. The method according to claim 12, wherein a number of printhead carriages is greater than a number of print regions.

20. The method according to claim 19, wherein at least a portion of at least one printhead carriage is adapted to be idle during printing.

21. The method according to claim 12, wherein a width of said medium is smaller than a width of said print area, and wherein each configuration in said predetermined set of configurations includes at least a portion of at least one printhead carriage positioned beyond an edge of said medium.

22. The method according to claim 21, wherein said medium is centered in said print area.

23. A program product, comprising machine readable program code for causing a machine to perform the following method steps:

selecting a configuration from a set of predetermined configurations of positions of two or more printhead carriages adapted to print on a medium in a print area including one or more print regions, each of said printhead carriages being adapted to print in one or more of said print regions; and reconfiguring a positioning of said two or more printhead carriages in said configuration selected in said step of selecting when a predetermined criterion is satisfied to ensure that each of said printhead carriages is not used at a much greater rate than other said printhead carriages.

24. The program product according to claim 23, wherein said step of reconfiguring includes reconfiguring said positioning after a predetermined number of print jobs.

25. The program product according to claim 23, wherein said step of reconfiguring includes reconfiguring said positioning after a predetermined number of pages.

26. The program product according to claim 23, wherein said step of selecting selects a configuration according to a predetermined sequence of configurations.

27. The program product according to claim 23, wherein said step of selecting includes randomly selecting a configuration from said set of configurations.

* * * * *

UNITED STATES PATENT AND TRADEMARK OFFICE

CERTIFICATE OF CORRECTION

PATENT NO. : 7,284,821 B2
APPLICATION NO. : 10/830833
DATED : October 23, 2007
INVENTOR(S) : Morgan Jones et al.

It is certified that error appears in the above-identified patent and that said Letters Patent is hereby corrected as shown below:

In column 5, line 36, in Claim 6, delete "member" and insert -- number --, therefor.

In column 5, line 37, in Claim 7, delete "claim 6." and insert -- claim 6, --, therefor.

Signed and Sealed this

Fifth Day of August, 2008

JON W. DUDAS
*Director of the United States Patent and Trademark Office*